US007980106B2

(12) United States Patent
Huang et al.

(10) Patent No.: US 7,980,106 B2
(45) **Date of Patent: *Jul. 19, 2011**

(54) REKEYABLE LOCK CYLINDER, PLUG ASSEMBLY OF THE SAME AND METHOD FOR REKEYING THE SAME

(75) Inventors: Chao-Ming Huang, Kaohsiung County (TW); Chi-Ming Chen, Kaohsiung County (TW)

(73) Assignee: Taiwan Fu Hsing Industrial Co., Ltd., Kang-Shan Town, Kaosiung County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/572,937

(22) Filed: Oct. 2, 2009

(65) Prior Publication Data

US 2010/0018267 A1 Jan. 28, 2010

Related U.S. Application Data

(63) Continuation-in-part of application No. 12/149,757, filed on May 7, 2008, now Pat. No. 7,624,606.

(51) Int. Cl.
*E05B 27/04* (2006.01)
*E05B 29/04* (2006.01)

(52) U.S. Cl. ..... 70/383; 70/340; 70/368; 70/384; 70/492; 70/493; 70/495

(58) Field of Classification Search ..... 70/491–496, 70/337–343, 368, 382–385, 392, 376, 377, 70/DIG. 21, DIG. 22
See application file for complete search history.

(56) References Cited

U.S. PATENT DOCUMENTS

| | | | | |
|---|---|---|---|---|
| 2,155,734 | A * | 4/1939 | Olson | 70/358 |
| 3,578,371 | A * | 5/1971 | Keller | 70/492 |
| 7,360,382 | B2 * | 4/2008 | Fernandez | 70/360 |
| 7,392,677 | B1 * | 7/2008 | Fan | 70/495 |
| 7,448,239 | B1 * | 11/2008 | Huang et al. | 70/360 |
| 7,448,240 | B1 * | 11/2008 | Huang et al. | 70/492 |
| 7,526,935 | B2 * | 5/2009 | Huang et al. | 70/360 |
| 7,624,606 | B1 * | 12/2009 | Huang et al. | 70/338 |
| 7,628,048 | B2 * | 12/2009 | Huang et al. | 70/338 |
| 7,634,931 | B2 * | 12/2009 | Segien et al. | 70/384 |
| 2004/0069030 | A1 * | 4/2004 | Takadama | 70/495 |
| 2006/0059965 | A1 * | 3/2006 | Benstead | 70/493 |
| 2008/0307841 | A1 * | 12/2008 | Huang et al. | 70/491 |

* cited by examiner

*Primary Examiner* — Lloyd A Gall
(74) *Attorney, Agent, or Firm* — Muncy, Geissler, Olds & Lowe, PLLC

(57) ABSTRACT

A rekeyable lock cylinder comprises a cylinder body and a plug assembly disposed within the cylinder body. The plug assembly comprises a plug body, a plurality of pin assemblies and a guide bar. The plug body has a longitudinal axis, a transverse axis perpendicular to the longitudinal axis and a tool-receiving hole. Each of the pin assemblies is movably disposed in the plug body and comprises a first rack component and a second rack component selectively engaging with the first rack component. The guide bar is coupled to the plug body and has a plurality of pin runners for engaging with the first rack components and a tool-receiving portion exposed by the tool-receiving hole. The guide bar is capable of moving along transverse axis-direction of the plug body to disengage the first rack components from the second rack components.

15 Claims, 14 Drawing Sheets

REKEYABLE LOCK CYLINDER, PLUG ASSEMBLY OF THE SAME AND METHOD FOR REKEYING THE SAME

CROSS REFERENCE TO RELATED APPLICATIONS

This application is a Continuation-in-Part of application Ser. No. 12/149,757, filed on May 7, 2008, now U.S. Pat. No. 7,624,606 and for which priority is claimed under 35 U.S.C. §120, the entire contents of which are hereby incorporated by reference.

FIELD OF THE INVENTION

The present invention is generally relating to a lock cylinder, more particularly to a rekeyable lock cylinder and rekeying method thereof.

BACKGROUND OF THE INVENTION

Lock cylinder of known lock device typically is matched with a proper key so lock cylinder as well as key must be replaced in pair while replacing a lock, which results in high lock-replacing cost and inconvenience in use.

SUMMARY

The primary object of the present invention is to provide a rekeyable lock cylinder and rekeying method thereof. First, a first matched key is inserted into a plug body and then turned to drive the plug body and a guide bar turning. Next, a rekeying tool is inserted into a tool-receiving hole of the plug body to push a tool-receiving portion of the guide bar and enable a plurality of first rack components to move along transverse axis-direction of the plug body for disengaging from a plurality of second rack components. Then, the first matched key is pulled out before inserting a second matched key into the plug body. Finally, the rekeying tool is pulled out to make the first rack components reengage with the second rack components. Accordingly, the present invention may provide advantages of widely lowering re-keying cost and enhancing convenience in use, because lock replacement can be completed as soon as re-keying another matched key only without replacing lock cylinder.

A rekeyable lock cylinder in accordance with the present invention comprises a cylinder body and a plug assembly disposed within the cylinder body. The plug assembly comprises a plug body, a plurality of pin assemblies and a guide bar, wherein the plug body has a longitudinal axis, a transverse axis perpendicular to the longitudinal axis and a tool-receiving hole, each of the pin assemblies is movably disposed in the plug body and comprises a first rack component and a second rack component selectively engaging with the first rack component, and the guide bar coupled to the plug body has a plurality of pin runners servicing for engaging with the first rack components and a tool-receiving portion exposed by the tool-receiving hole. The tool-receiving portion has a tool-contacting surface facing the first rack components and the guide bar is configured to move the first rack components transversely to the longitudinal axis of the plug body to disengage the first rack components from the second rack components.

Rekeying method of a rekeyable lock cylinder in accordance with the present invention comprises initially providing a rekeyable lock cylinder, which comprises a plug body, a guide bar disposed at the plug body and a plurality of pin assemblies. The plug body has a transverse axis and a tool-receiving hole. Each of the pin assemblies comprises a first rack component and a second rack component in engagement with the first rack component. The guide bar has a tool-contacting surface facing the first rack components. Next, a first matched key is inserted into the plug body and then turned to drive the plug body and the guide bar turning. Then a rekeying tool is inserted into the tool-receiving hole to push the tool-contacting surface of the guide bar, which enables the first rack components to move along transverse axis-direction of the plug body to disengage from the second rack components. Next, a second matched key is inserted into the plug body after pulling out the first matched key. Finally, the rekeying tool is pulled out to make the first rack components reengage with the second rack components.

DESCRIPTION OF THE DRAWINGS

FIGS. 1*c*-1*d* are views of a second rack component for use in the present invention.

DETAILED DESCRIPTION OF THE INVENTION

Figure 1:
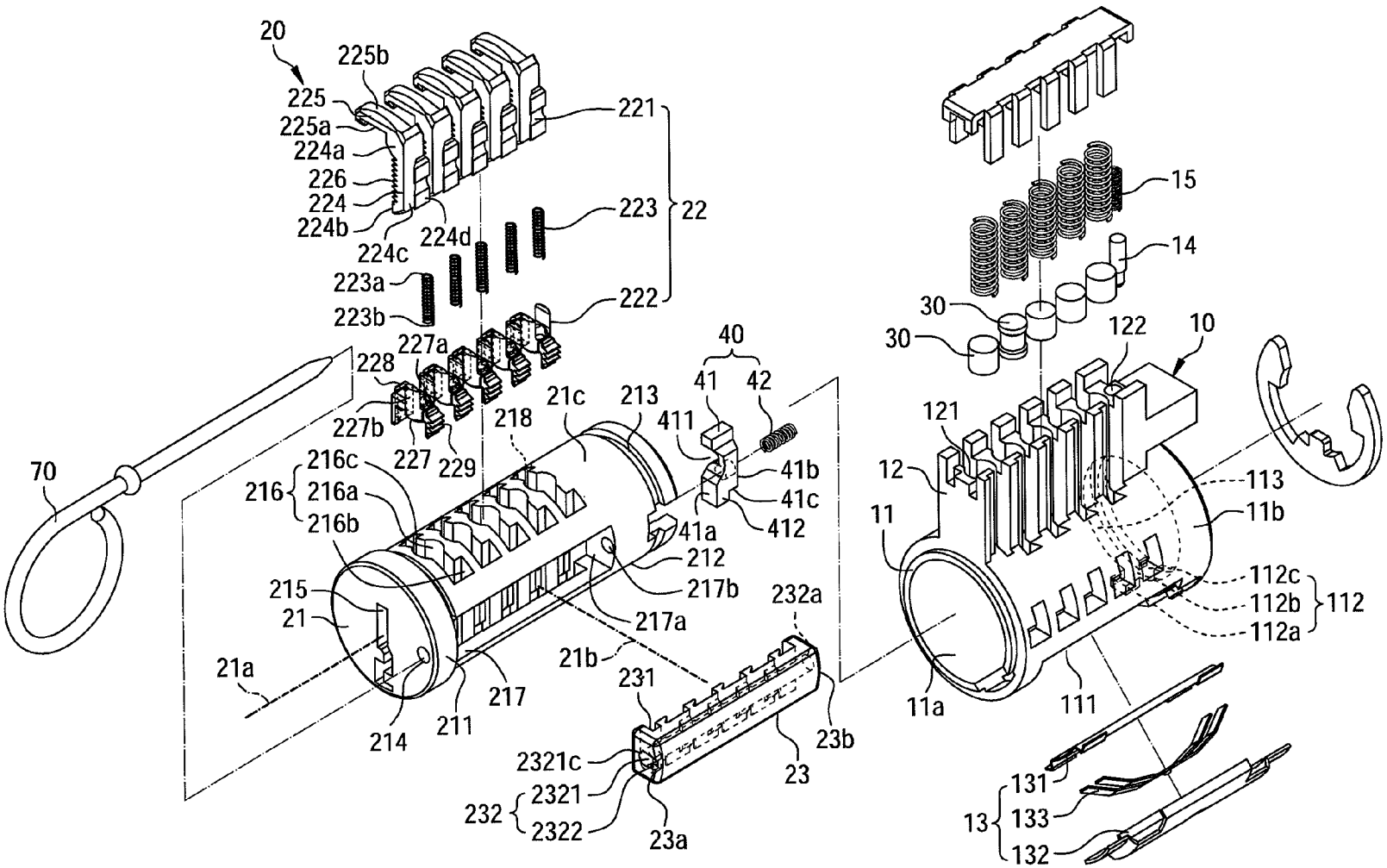
FIG. 1 is an exploded perspective view illustrating a rekeyable lock cylinder in accordance with a preferred embodiment of the present invention.
Figure 1A:
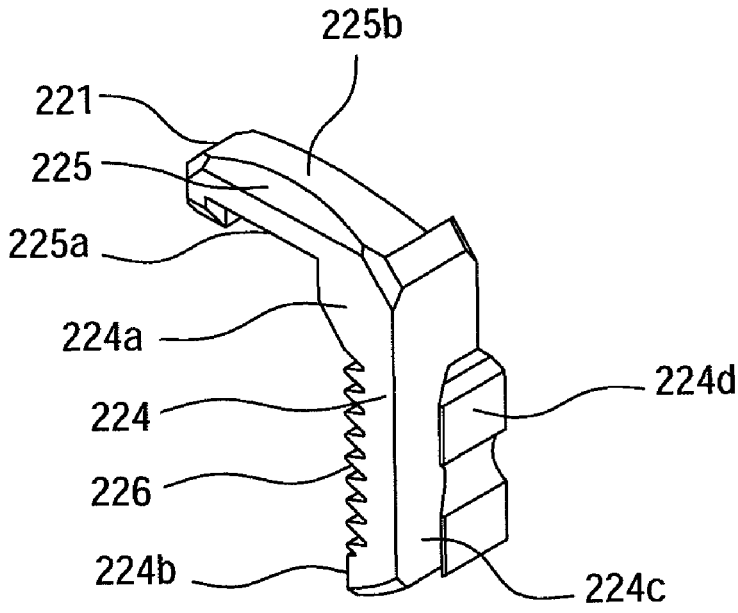
FIGS. 1*a*-1*b* are views of a first rack component for use in the present invention.
Figure 1B:
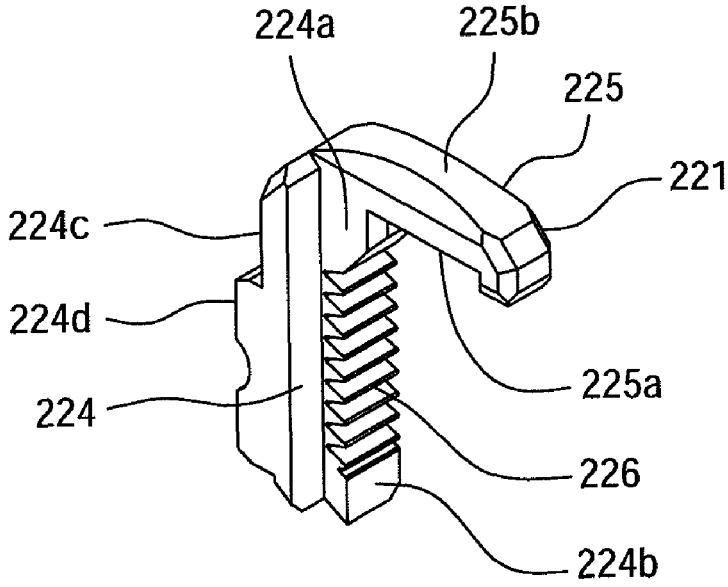
Figure 2:
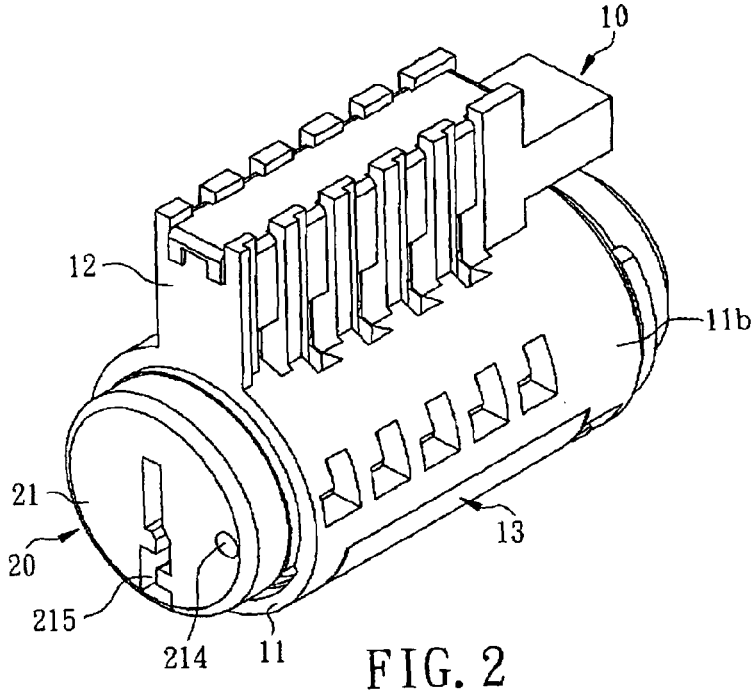
FIG. 2 is an assembled perspective view illustrating the rekeyable lock cylinder.
Figure 3A:
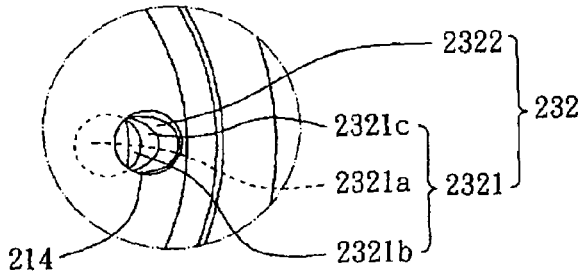
FIG. 3*a* is an enlarged view of the rekeyable lock cylinder of FIG. 3 taken from the encircled dotted line portion of FIG. 3.
Figure 3:
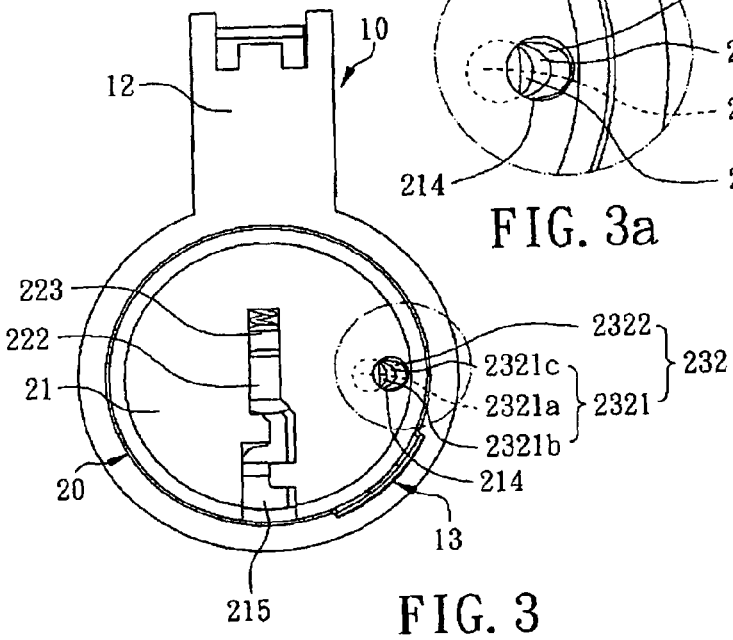
FIG. 3 is a side view illustrating the rekeyable lock cylinder.
Figure 4:
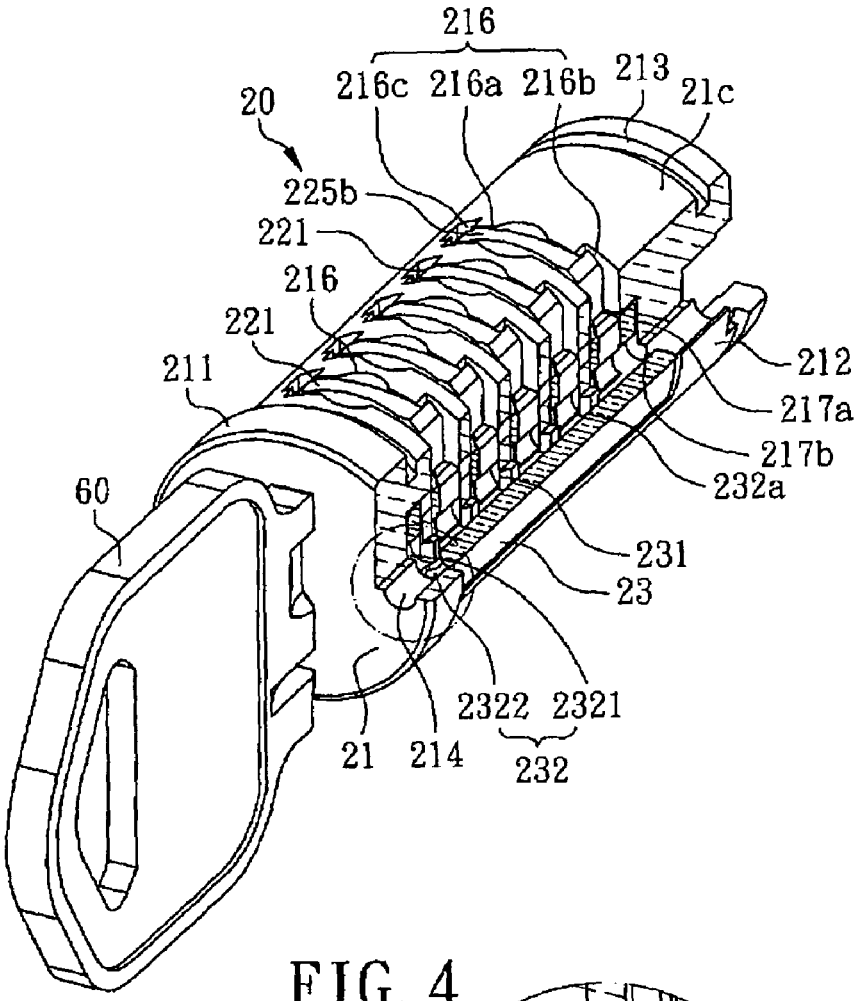
FIG. 4 is an assembled perspective view illustrating a plug assembly in accordance with a preferred embodiment of the present invention.
Figure 4A:
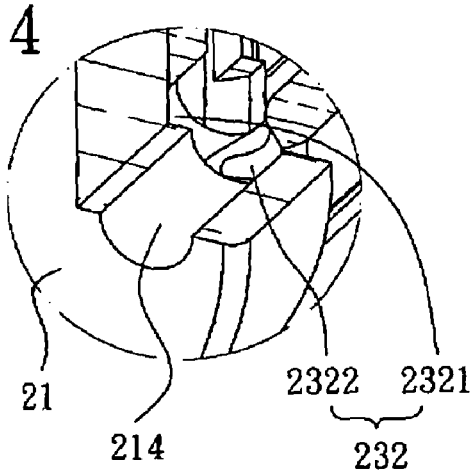
FIG. 4*a* is an enlarged view of the plug assembly of FIG. 4 taken from the encircled dotted line portion of FIG. 4.
Figure 5:
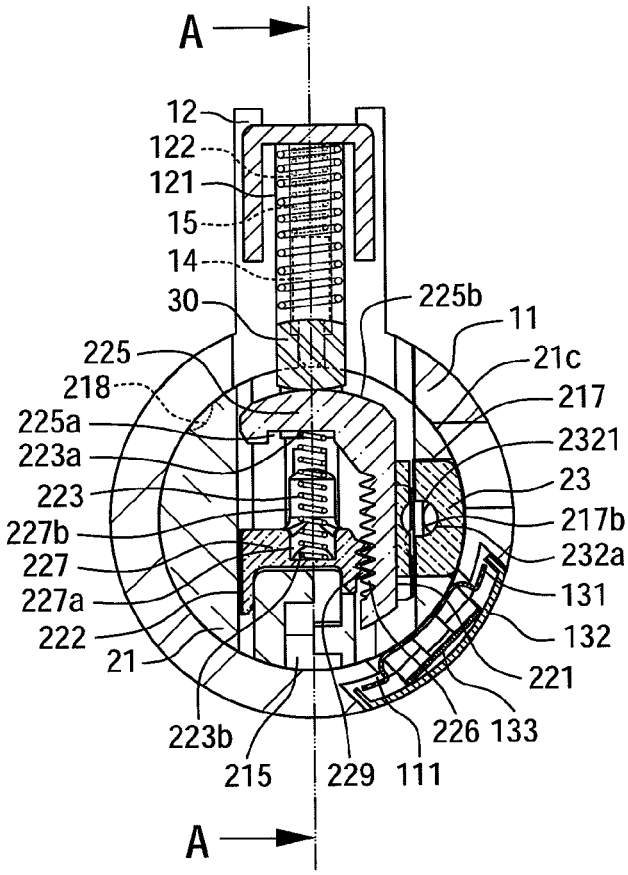
FIG. 5 is an assembled longitudinal section view illustrating the rekeyable lock cylinder.
Figure 6:
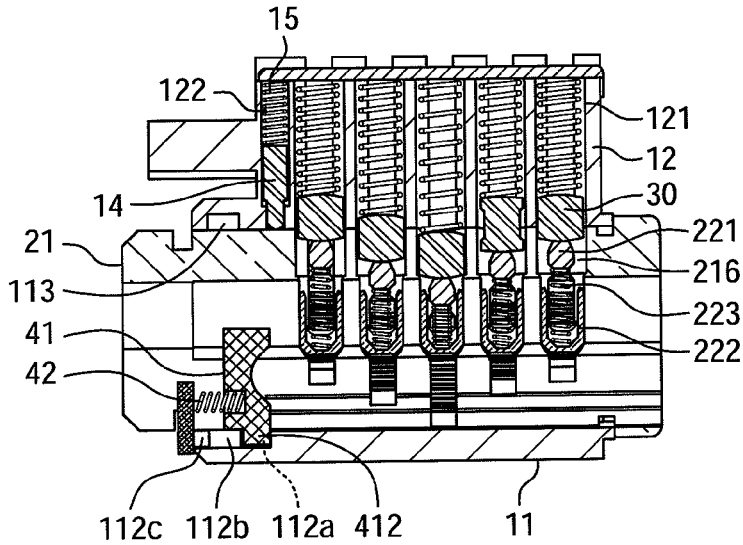
FIG. 6 is a transverse section view illustrating the rekeyable lock cylinder along A-A line of FIG. 5.

FIGS. 1 and 2 illustrates a rekeyable lock cylinder in accordance with a preferred embodiment of the present invention comprising a cylinder body 10, a plug assembly 20 disposed within the cylinder body 10 and a plurality of upper pins 30. The cylinder body 10 comprises a hollow cylinder portion 11 for accommodating the plug assembly 20, an extending protrusion 12 formed at one side of the hollow cylinder portion 11, a resilient assembly 13 disposed at the hollow cylinder portion 11, a location bar 14 and a first spring 15 serving for pushing the location bar 14. Or, the cylinder body 10 may omit manufacturing the extending protrusion 12 in another embodiment. In this embodiment, the hollow cylinder portion 11 has an inside wall 11*a*, an outside wall 11*b*, a recession 111, an axial groove 112 and a radial groove 113, wherein the recession 111, the axial groove 112 and the radial groove 113 are recessed from the inside wall 11*a*. Preferably, the recession 111 communicates with the inside wall 11 a and the outside wall 11*b*. The axial groove 112 in communication with the radial groove 113 comprises a first limiting area 112*a*, an overlapping area 112*b* and a second limiting area 112*c*, wherein the overlapping area 112*b* is where the axial groove 112 communicates with and intersects the radial groove 113, the first limiting area 112*a* and the second limiting area 112*c* are respectively located at the two sides of the overlapping area 112*b*. The extending protrusion 12 has a plurality of upper pin holes 121 and a straight slot 122 parallel to the upper pin holes 121, the upper pin holes 121 and the straight slot 122 communicate with the hollow cylinder portion 11. Referring to FIGS. 1, 2 and 4, the resilient assembly 13 disposed at the recession 111 of the hollow cylinder portion 11 has a movable plate 131, an immovable plate 132 affixed at the recession 111 and at least one resilient member 133 disposed between the movable plate 131 and the immovable plate 132. In this embodiment, the movable plate 131 is transversely movable within the recession 111 and two ends of the resilient member 133 contact against the movable plate 131 and the immovable plate 132 respectively. In addition, the location bar 14 and the first spring 15 are disposed within the straight slot 122 of the extending protrusion 12 in this embodiment.

Figure 8:
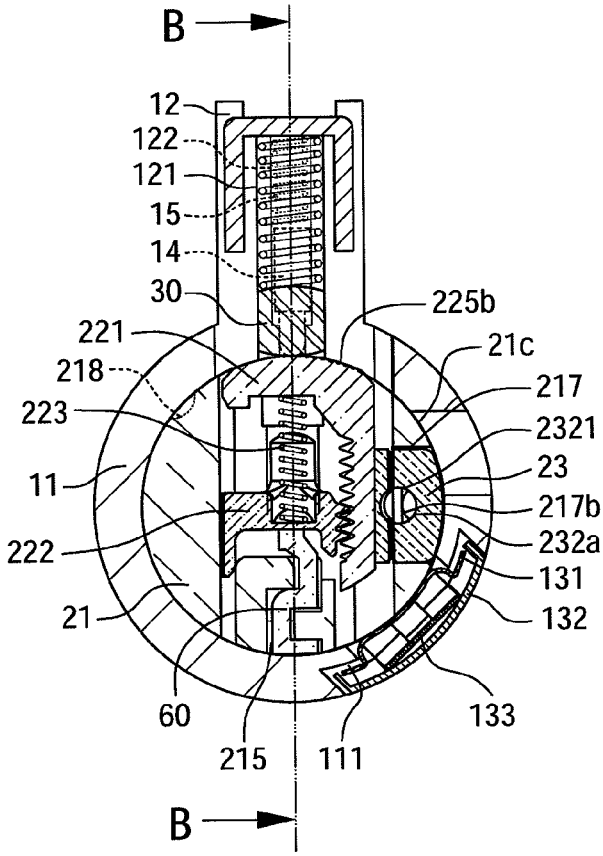
FIG. 8 is a longitudinal section view illustrating the first matched key is inserted into the rekeyable lock cylinder in accordance with a preferred embodiment of the present invention.
Figure 10:
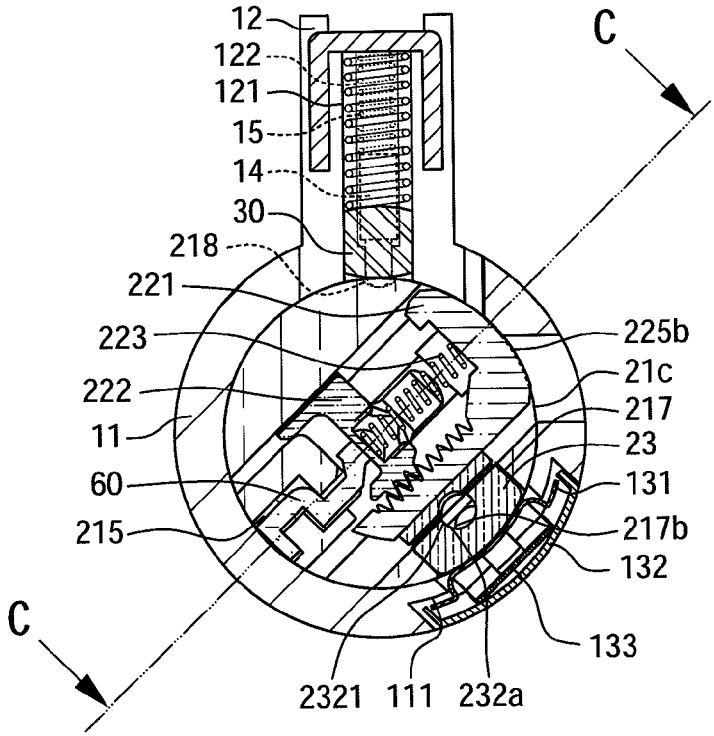
FIG. 10 is a longitudinal section view illustrating the first matched key is turned 45-degrees clockwise in accordance with a preferred embodiment of the present invention.

Referring to FIGS. 1 and 4, the plug assembly 20 comprises a plug body 21, a plurality of pin assemblies 22 and a guide bar 23 coupled to the plug body 21. The plug body 21 has a longitudinal axis 21*a*, a transverse axis 21b perpendicular to the longitudinal axis 21*a*, an outer surface 21*c*, a front portion 211, a middle portion 212, a drive portion 213, a tool-receiving hole 214 penetrating the front portion 211 and a keyhole 215. In this embodiment, the middle portion 212 has a plurality of pin holes 216 serving for disposing the pin assemblies 22, a trench 217 communicating with the pin holes 216 and a catching slot 218, wherein each of the pin holes 216 has a center hole portion 216*a*, a first cavity portion 216*b* formed at one side of the center hole portion 216*a* and a second cavity portion 216*c* formed at another side of the center hole portion 216*a*, besides the first cavity portion 216*b* and the second cavity portion 216*c* are in communication with the center hole portion 216*a*. The trench 217 has a trench wall 217*a* facing the tool-receiving hole 214 and a tool-fixing hole 217*b* recessing from the trench wall 217*a*, and preferably the tool-fixing hole 217*b* corresponds to the tool-receiving hole 214. Besides, the tool-receiving hole 214 communicates with the trench 217. Referring to FIGS. 1, 1*a*, 1*b*, 1*c*, 1*d*, 4, 6 and 22, the pin assemblies 22 are respectively disposed within the pin holes 216 of the plug body 21. In this embodiment, the pin assemblies 22 are height-adjustable pins and each of the pin assemblies 22 comprises a first rack component 221 engaged with the guide bar 23, a second rack component 222 selectively engaging with the first rack component 221 and an elastic component 223 disposed between the first rack component 221 and the second rack component 222. Each of the first rack components 221 has a rib portion 224 having a top end 224*a*, a front lateral 224*b*, a back lateral 224*c* and a catching protrusion 224*d* protruding from the back lateral 224*c*, an extending portion 225 formed extending from the top end 224*a* of the rib portion 224 and a first rack arrangement 226 formed on the front lateral 224*b* of the rib portion 224, wherein the extending portion 225 is slideably located in the center hole portion 216*a* of the pin hole 216, and the rib portion 224 is simultaneously located in the center hole portion 216*a* and the first cavity portion 216*b* of the pin hole 216. Each of the second rack components 222 has a main body 227 corresponding to the extending portion 225 of the first rack component 221, a guiding portion 228 formed at one side of the main body 227 and a second rack arrangement 229 formed at another side of the main body 227, wherein the main body 227 and the second rack arrangement 229 are located in the center hole portion 216*a* of the pin hole 216, and the guiding portion 228 is located in the second cavity portion 216*c* of the pin hole 216. Referring to FIGS. 1, 1*a*, 1*b*, 1*c*, 1*d* and 5, each of the elastic components 223 has a first end 223*a* contacting against the first rack component 221 and a second end 223*b* contacting against the second rack component 222, in this embodiment, the first ends 223*a* of the elastic components 223 contact against the extending portions 225 of the first rack components 221 respectively, and the second ends 223*b* of the elastic components 223 contact against the main bodies 227 of the second rack components 222 respectively. Preferably, each of the extending portions 225 has a notch 225*a* and an arc surface 225*b*, the first end 223*a* of the elastic component 223 is disposed within the notch 225*a* of the extending portion 225, besides referring to FIGS. 5, 8 and 10, the arc surface 225*b* of the extending portion 225 is capable of selectively flushing with the outer surface 21*c* of the plug body 21. Each of the main bodies 227 has an accommodating cavity 227*a* and a pair of flanks 227*b* formed protruding from a periphery of the accommodating cavity 227*a*, the second end 223*b* of the elastic component 223 is disposed within the accommodating cavity 227*a* of the main body 227, and the flanks 227*b* are corresponding to each other and capable of orientating the elastic component 223. Referring to FIGS. 1, 3, 3*a*, 4, 4*a* and 22, the guide bar 23 disposed at the trench 217 of the middle portion 212 of the plug body 21 has a first side 23*a* facing the tool-receiving hole 214, a second side 23*b* facing the drive portion 213, a plurality of pin runners 231 serving for engaging with the first rack components 221 and a tool-receiving portion 232 exposed by the tool-receiving hole 214, wherein each of the pin runners 231 is engaged with the rib portion 224 of the first rack component 221, preferably each of the pin runners 231 is engaged with the catching protrusion 224*d* of the rib portion 224. The tool-receiving portion 232 has a groove 2321 recessed from the first side 23*a*, a chute 2322 recessed from the first side 23*a* and a tool-contacting surface 232*a* located within the groove 2321, preferably the groove 2321 is in communication with the first side 23*a* and the second side 23*b*. The groove 2321 has a first groove portion 2321*a*, a second groove portion 2321*b* corresponding to the tool-receiving hole 214 and an inner wall 2321*c*. The chute 2322 communicates with the groove 2321 and the tool-contacting surface 232*a* faces the first rack components 221, and preferably the tool-contacting surface 232*a* is part of the inner wall 2321*c*. Referring again to FIGS. 1 and 6, the upper pins 30 are configured and disposed to move in the upper pin holes 121 of the extending protrusion 12 of the cylinder body 10 and the pin holes 216 of the middle portion 212 of the plug body 21, wherein at least one of the upper pins 30 is in shape of I so as to enhance the anti-thief performance of the rekeyable lock cylinder.

Moreover, referring again to FIGS. 1 and 6, the present invention further comprises a limit assembly 40 disposed at the plug body 21 as to enhance burglar-proofness and security. The limit assembly 40 has a limiting block 41 and a second spring 42 contacting against the limiting block 41. The limiting block 41, disposed at the keyhole 215 of the plug body 21 and adjacent to the drive portion 213, projects from the plug body 21 and corresponds to the axial groove 112 of the hollow cylinder portion 11. In this embodiment, the limiting block 41 can move within the axial groove 112 of the hollow cylinder portion 11 and has a first lateral 41*a*, a chamfer 411 recessed from the first lateral 41*a* and corresponding to the keyhole 215, a second lateral 41*b* opposite to the first lateral 41*a*, a bottom surface 41*c* facing the axial groove 112 and a protrusion 412 projecting from the bottom surface 41*c*. The protrusion 412, also projecting from the plug body 21, is disposed to move within the axial groove 112 of the hollow cylinder portion 11 capable of limiting the plug body 21 not to be turned around. Referring again to FIGS. 1 and 6, the second spring 42 is disposed between the drive portion 213 of the plug body 21 and the limiting block 41 and one end of the second spring 42 contacts against the second lateral 41*b* of the limiting block 41. In this embodiment, if an unmatched key (not shown in the drawings) is inserted into the keyhole 215 of the plug body 21 with opportune beat and turn for unlocking in a locked condition, it merely makes that the protrusion 412 of the limiting block 41 moves from the first limiting area 112*a* of the axial groove 112 to the second limiting area 112*c*. While the upper pins 30 or the pin assemblies 22 cannot limit the plug body 21 to not be turned around, the protrusion 412 still can limit the plug body 21 to not be turned around. The present invention also utilizes the limiting block 41 and the second spring 42 to strength lock cylinder structure and increases unlocking difficulty for an unmatched key, thereby widely enhancing burglar-proofness and security of the lock cylinder structure.

Figure 7:
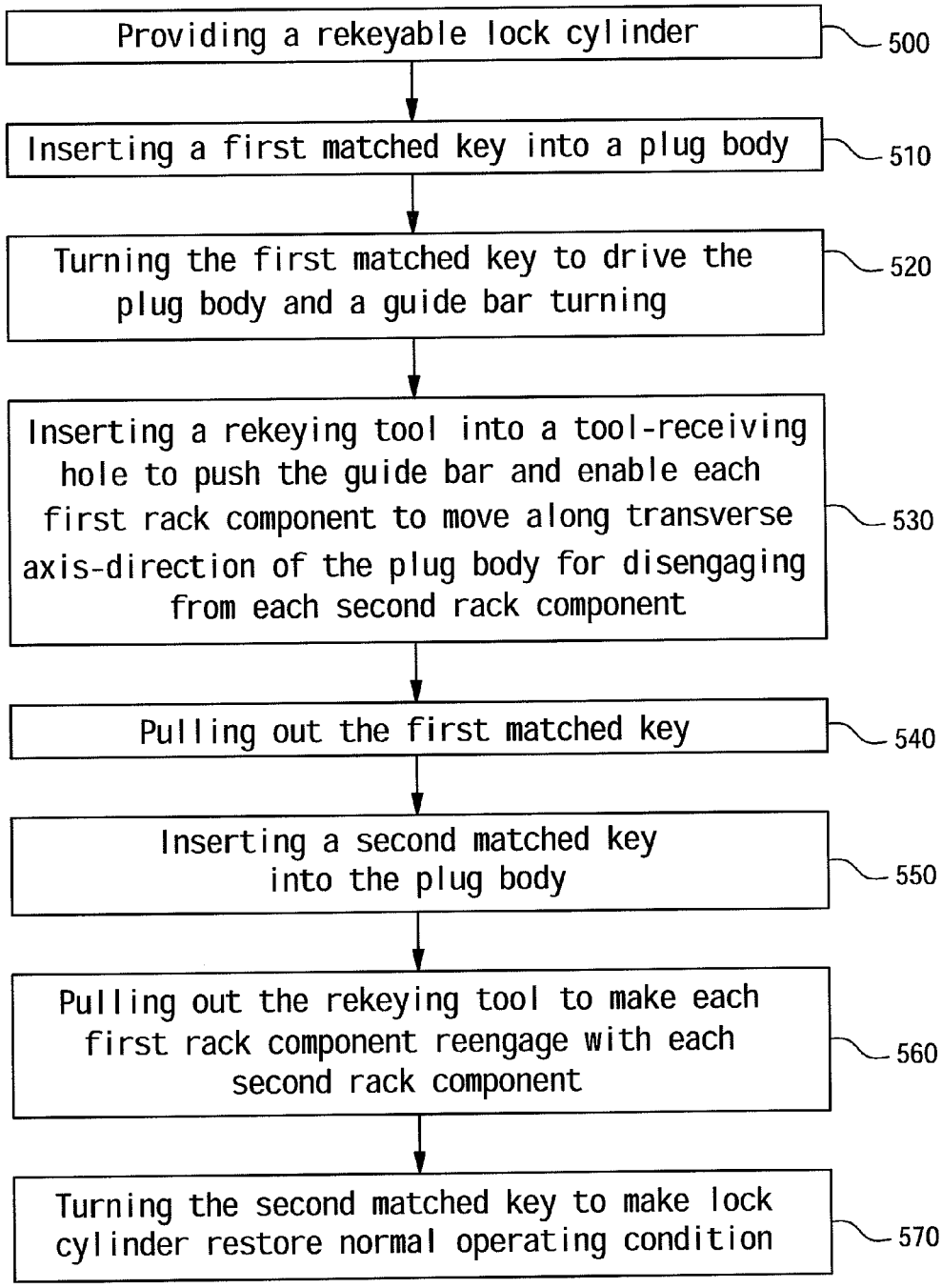
FIG. 7 is a flow chart for rekeying method of the rekeyable lock cylinder.
Figure 9:
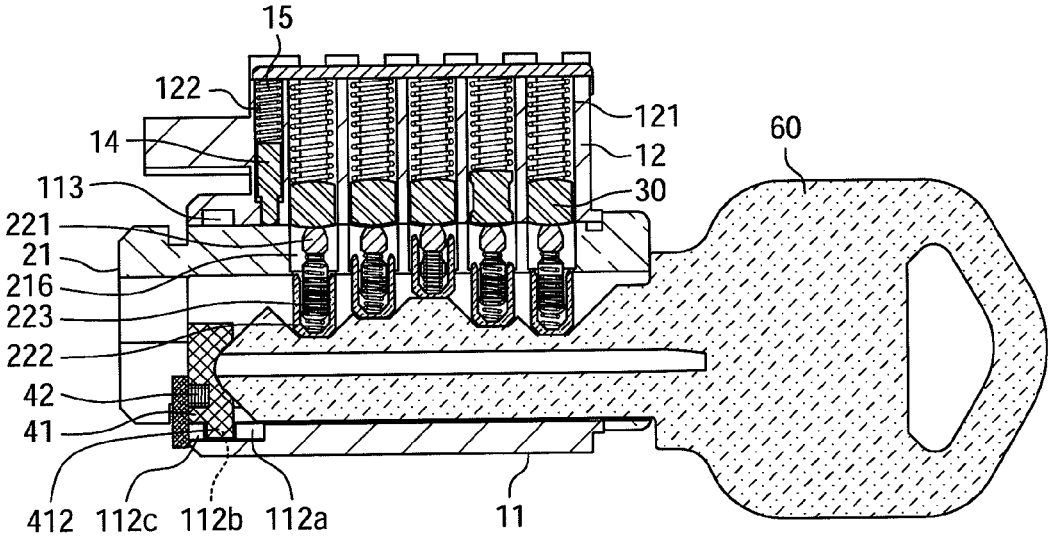
FIG. 9 is a transverse section view illustrating the first matched key is inserted into the rekeyable lock cylinder along B-B line of FIG. 8.
Figure 11:
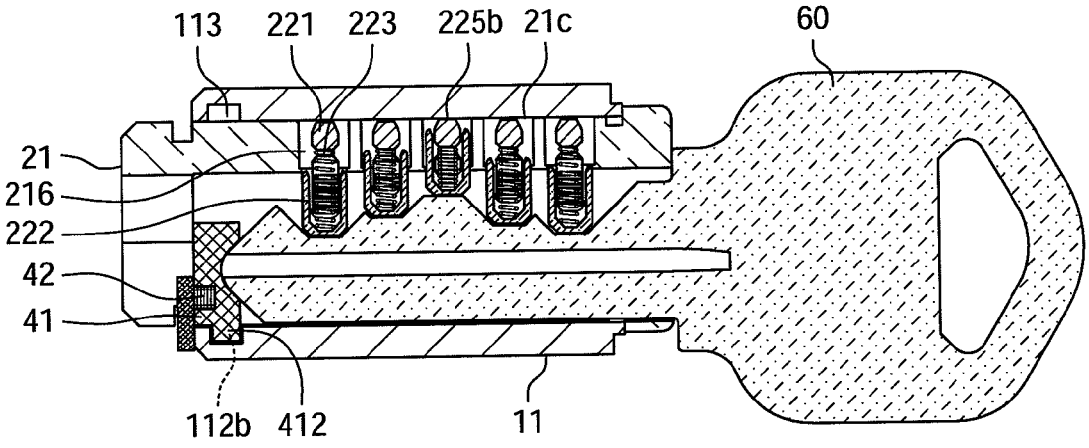
FIG. 11 is a transverse section view illustrating the first matched key is turned 45-degrees clockwise along C-C line of FIG. 10.
Figure 12:
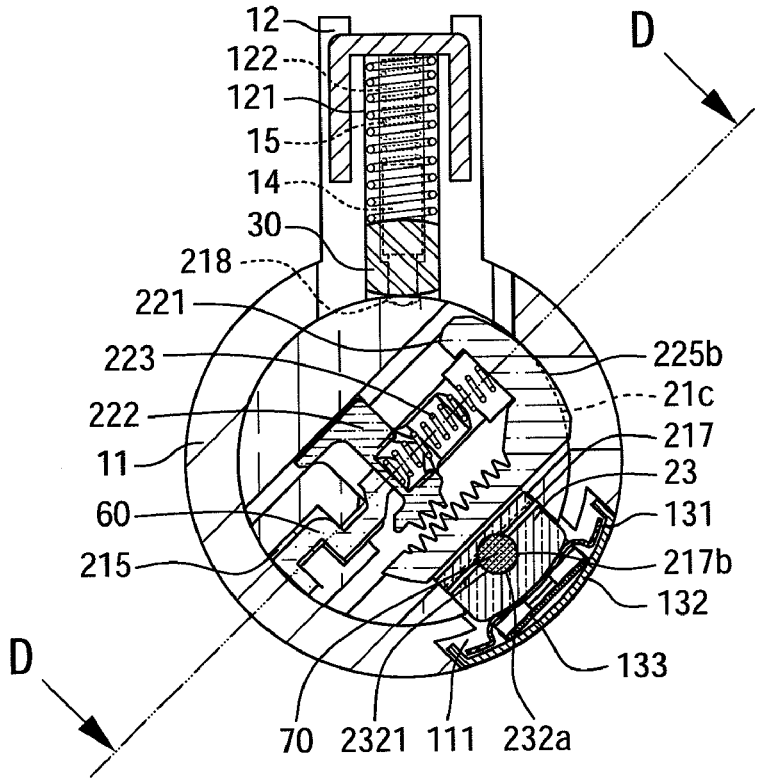
FIG. 12 is a longitudinal section view illustrating the rekeying tool is inserted into the rekeyable lock cylinder in accordance with a preferred embodiment of the present invention.
Figure 13:
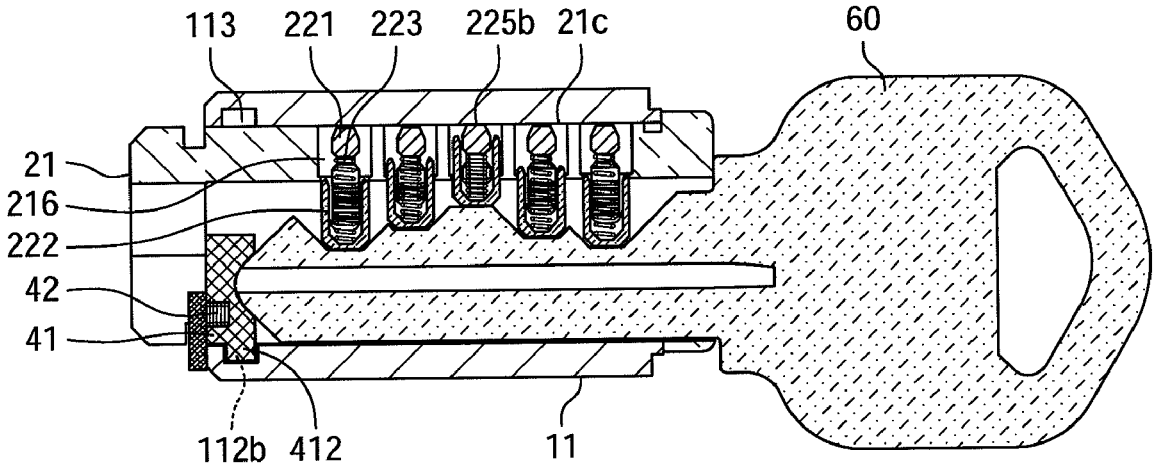
FIG. 13 is a transverse section view illustrating the rekeying tool is inserted into the rekeyable lock cylinder along D-D line of FIG. 12.
Figure 14:
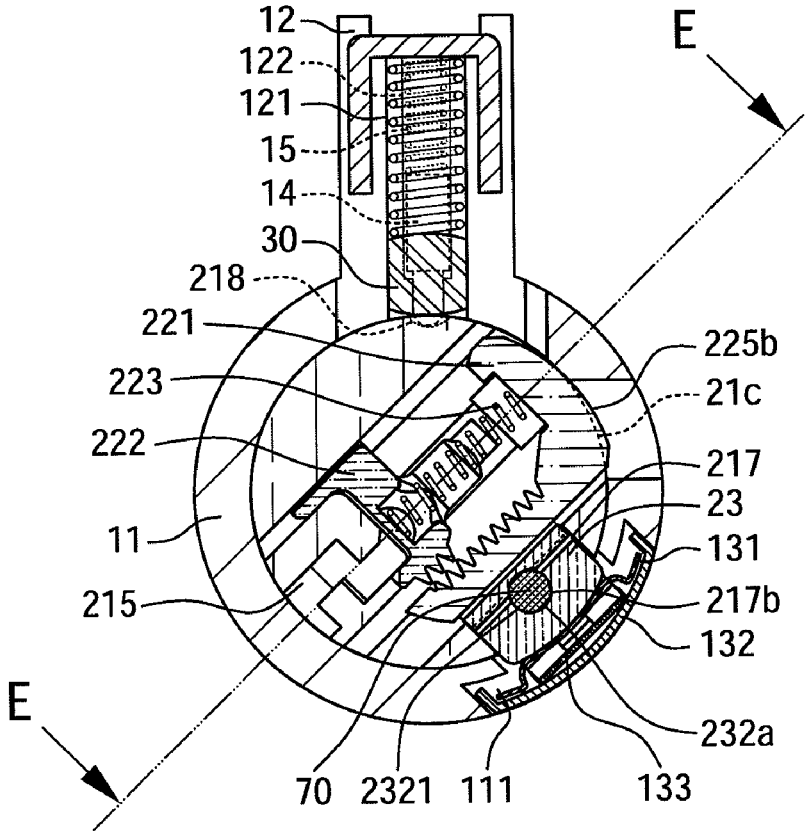
FIG. 14 is a longitudinal section view illustrating the first matched key is pulled out in accordance with a preferred embodiment of the present invention.
Figure 15:
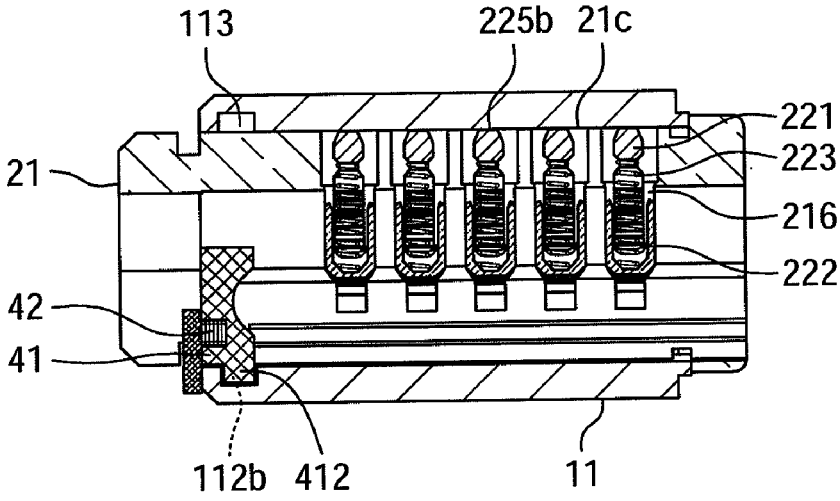
FIG. 15 is a transverse section view illustrating the first matched key is pulled out along E-E line of FIG. 14.
Figure 16:
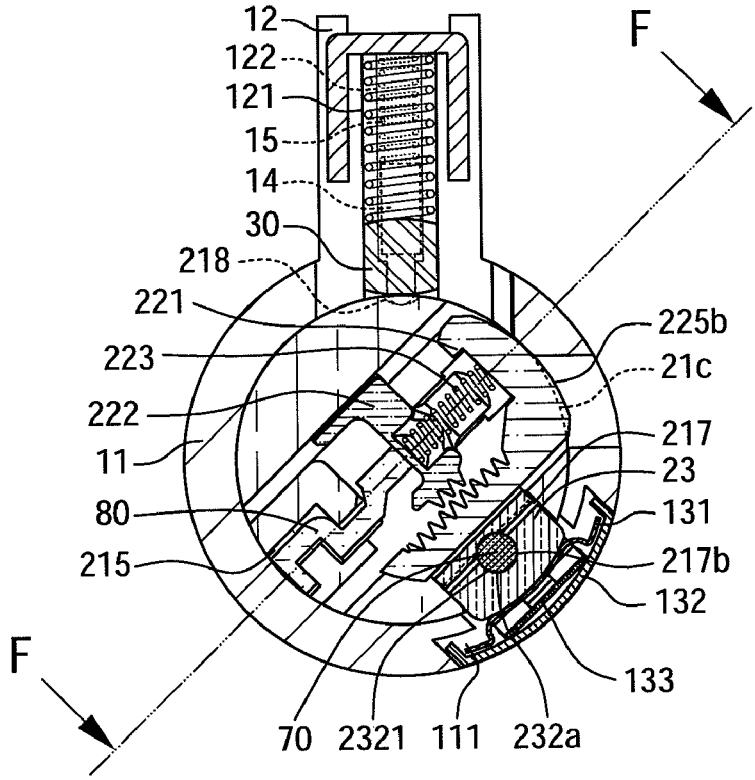
FIG. 16 is a longitudinal section view illustrating the second matched key is inserted into the rekeyable lock cylinder in accordance with a preferred embodiment of the present invention.
Figure 17:
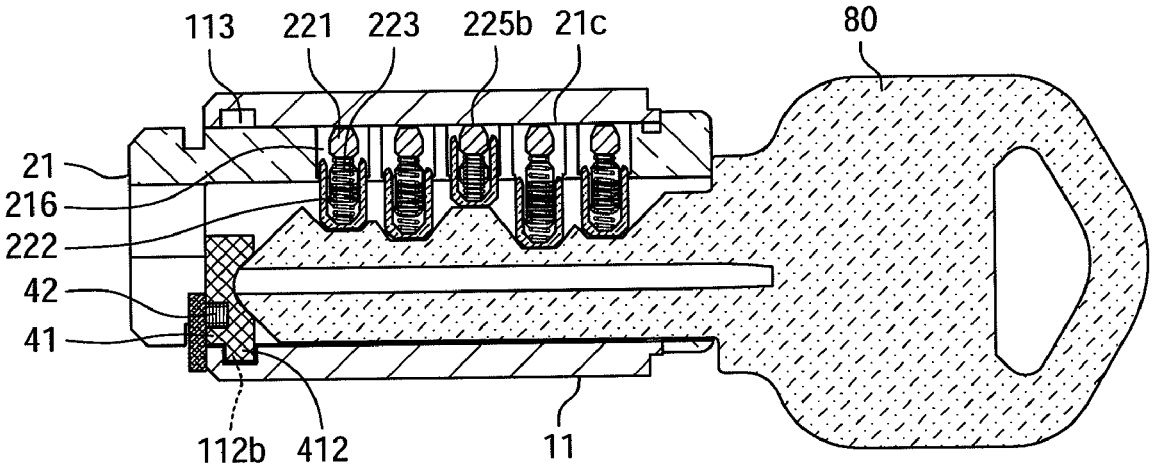
FIG. 17 is a transverse section view illustrating the second matched key is inserted into the rekeyable lock cylinder along F-F line of FIG. 16.
Figure 18:
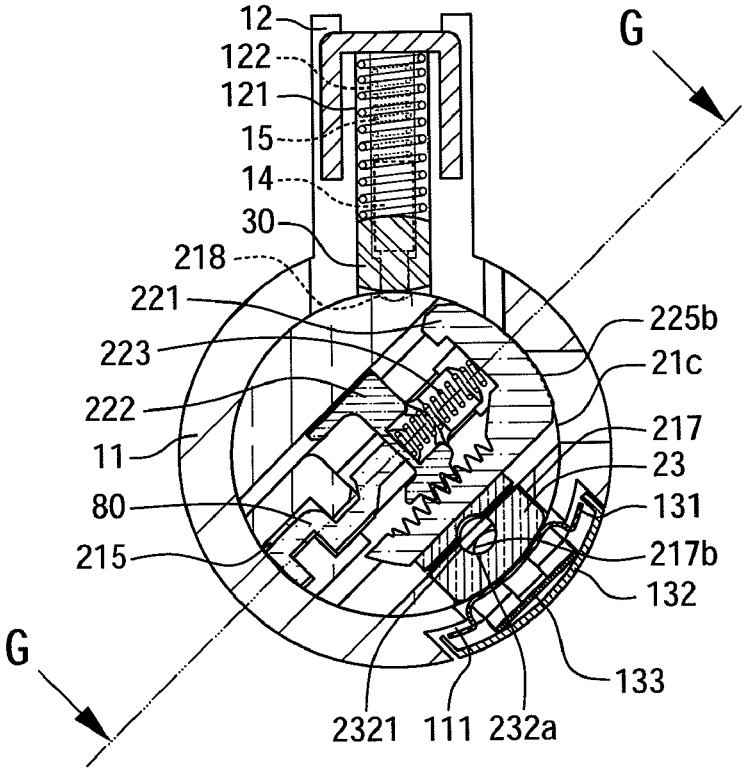
FIG. 18 is a longitudinal section view illustrating the rekeying tool is pulled out in accordance with a preferred embodiment of the present invention.
Figure 19:
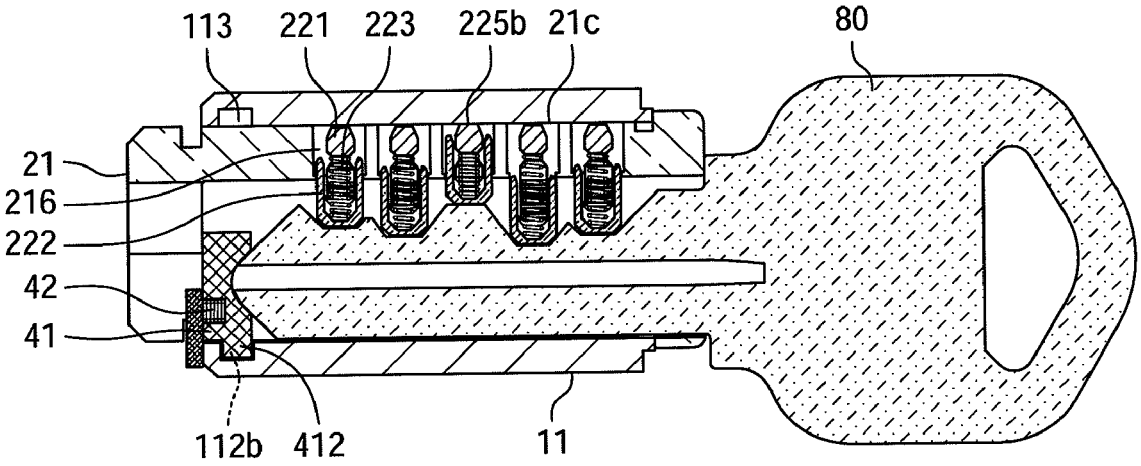
FIG. 19 is a transverse section view illustrating the rekeying tool is pulled out along G-G line of FIG. 18.
Figure 20:
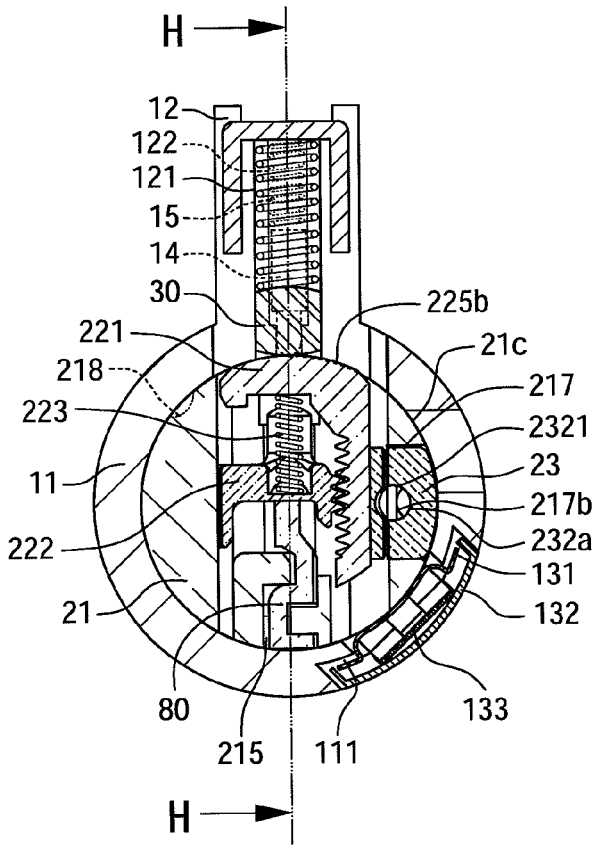
FIG. 20 is a longitudinal section view illustrating the rekeyable lock cylinder in normal service condition in accordance with a preferred embodiment of the present invention.
Figure 21:
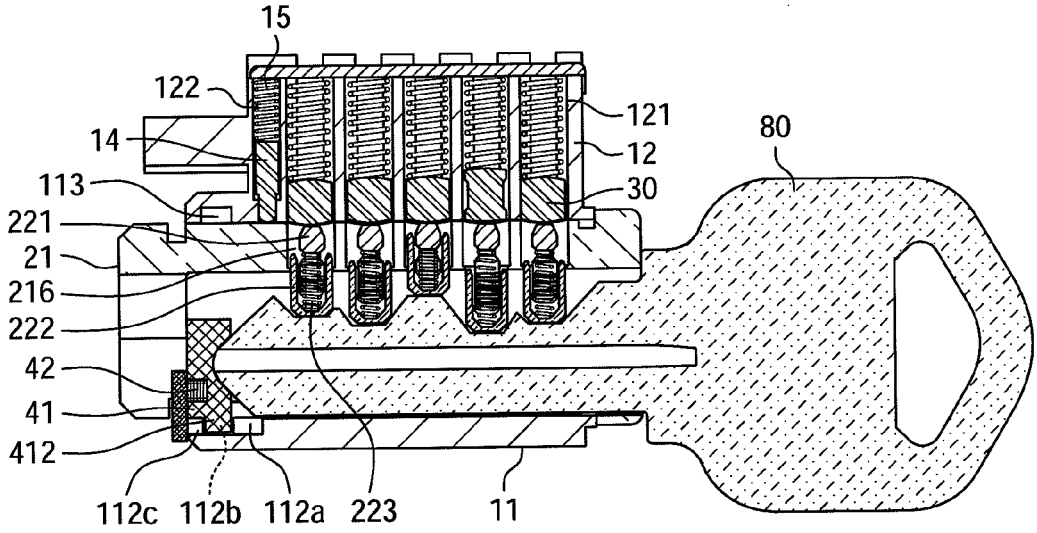
FIG. 21 is a transverse section view illustrating the rekeyable lock cylinder in normal service condition along H-H line of FIG. 20.
Figure 22:
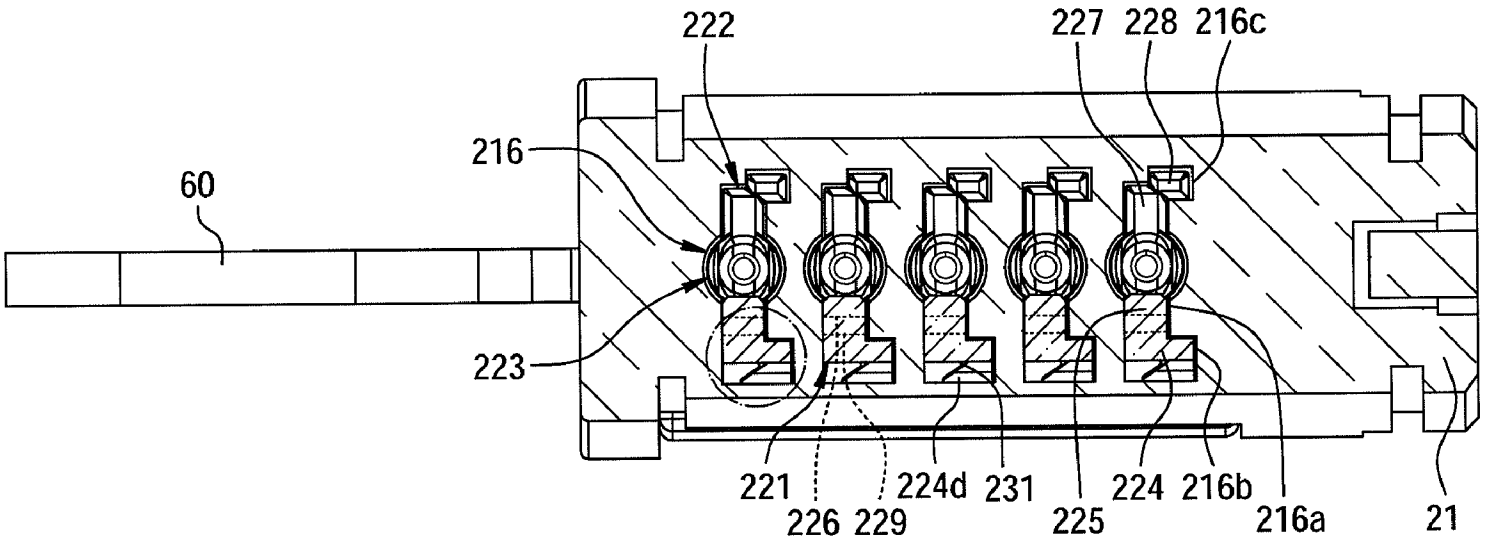
FIG. 22 is a cross-section view illustrating the plug assembly in the present invention.
Figure 22A:
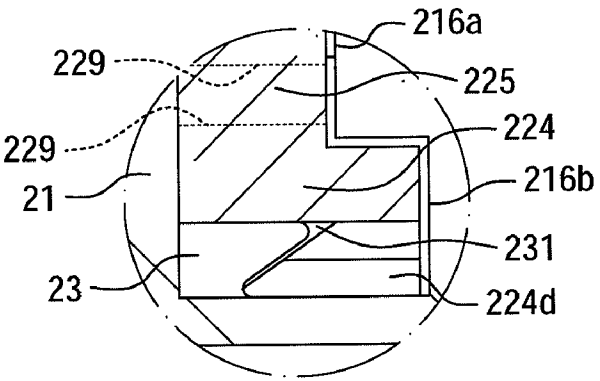
FIG. 22*a* is an enlarged view of the plug assembly of FIG. 22 taken from the encircled dotted line portion of FIG. 22.

FIGS. 7 illustrates rekeying method of the rekeyable lock cylinder comprising "providing a rekeyable lock cylinder" step 500, "inserting a first matched key into a plug body" step 510, "turning the first matched key to drive the plug body and a guide bar turning" step 520, "inserting a rekeying tool into a tool-receiving hole to push the guide bar and enable each first rack component to move along transverse axis-direction of the plug body for disengaging from each second rack component" step 530, "pulling out the first matched key" step 540, "inserting a second matched key into the plug body" step 550, "pulling out the rekeying tool to make each first rack component reengage with each second rack component" step 560 and "turning the second matched key to make lock cylinder restore normal operating condition" step 570. Initially, referring to FIGS. 2, 5 and 6, "providing a rekeyable lock cylinder" step 500 is performed, in which the rekeyable lock cylinder is composed by assembling the cylinder body 10, the plug assembly 20 and the upper pins 30. In this embodiment, the tool-receiving hole 214 corresponds to the second groove portion 2321*b* of the groove 2321 and there is a condition that the first rack components 221 are in engagement with the second rack components 222. Next, referring to FIGS. 7, 8 and 9, "inserting a first matched key into a plug body" step 510 is performed, in which a first matched key 60 is inserted into the keyhole 215 of the plug body 21 and pushes the pin assemblies 22 upwardly , wherein the arc surface 225*b* of the extending portion 225 is flushed with the outer surface 21*c* of the plug body 21. Next, referring to FIGS. 7, 10 and 11, "turning the first matched key to drive the plug body and a guide bar turning" step 520 is performed, in which the first matched key 60 is turned to drive the plug body 21 and the guide bar 23 turning to a predetermined angular position and the first matched key 60 is turned about 45-degrees clockwise in this embodiment. Meantime, the catching slot 218 of the middle portion 212 of the plug body 21 corresponds to the location bar 14 that allows the location bar 14 be caught by the catching slot 218, and the plug body 21, the guide bar 23 and the pin assemblies 22 are limited at 45-degrees position by the location bar 14, wherein the guide bar 23 corresponds to the recession 111 of the hollow cylinder portion 11 and the resilient assembly 13 and contacts against the movable plate 131 of the resilient assembly 13. Next, referring to FIGS. 1, 3, 3*a*, 7, 12 and 13, "inserting a rekeying tool into a tool-receiving hole to push a tool-receiving portion of the guide bar and enable each first rack component to move along transverse axis-direction of the plug body for disengaging from each second rack component" step 530 is performed, in which a rekeying tool 70 is inserted into the tool-receiving hole 214 of the plug body 21. Meantime, the rekeying tool 70 pushes the tool-contacting surface 232*a* of the tool-receiving portion 232 of the guide bar 23 for allowing the guide bar 23 to move to the resilient assembly 13. In this embodiment, the rekeying tool 70 first contacts against the chute 2322 of the tool-receiving portion 232 and then slides into the groove 2321 of the tool-receiving portion 232 along the chute 2322 and contacts against the tool-contacting surface 232*a*. When the rekeying tool 70 penetrates the groove 2321 of the tool-receiving portion 232, it pushes the guide bar 23 moving along transverse axis-direction of the plug body 21 and the movable plate 131 of the resilient assembly 13 is pushed by the guide bar 23 moving to the immovable plate 132 and compresses the resilient member 133. In this embodiment, a space needed for the guide bar 23 to move in can be provided by that the movable plate 131 moves away. Besides, the guide bar 23 moves to drive each of the first rack components 221 moving along transverse axis-direction of the plug body 21 capable of disengaging each of the first rack components 221 from each of the second rack components 222 and meantime the tool-receiving hole 214 corresponds to the first groove portion 2321*a* and the second groove portion 2321*b* of the groove 2321. In addition, the rekeying tool 70 is inserted into the tool-fixing hole 217*b* in this embodiment for affixing the guide bar 23 and the first rack components 221. Next, referring to FIGS. 7, 14 and 15, "pulling out the first matched key" step 540 is performed, in which the first matched key 60 is pulled out. When the first matched key 60 is pulled out in this embodiment, the second rack components 222 of the pin assemblies 22 are pushed by the elastic components 223 to fall to lowermost position. Next, referring to FIGS. 7, 16 and 17, "inserting a second matched key into the plug body" step 550 is performed, in which a second matched key 80 is inserted into the keyhole 215 of the plug body 21 and the second rack components 222 of the pin assemblies 22 in this embodiment will readjust height in accordance with different height of bitting of the second matched key 80. Next, referring to FIGS. 7, 18 and 19, "pulling out the rekeying tool to make each first rack component reengage with each second rack component" step 560 is performed, in which the rekeying tool 70 is pulled out and meantime the guide bar 23 is pushed by the resilient member 133 of the resilient assembly 13 to restore and drive the first rack components 221 to reengage with the second rack components 222. Finally, referring to FIGS. 7, 20 and 21, "turning the second matched key to make lock cylinder restore normal operating condition" step 570 is performed, in which the second matched key 80 is turned to make the rekeyable lock cylinder restore normal operating condition.

While the present invention has been particularly illustrated and described in detail with respect to the preferred embodiments thereof, it will be clearly understood by those skilled in the art that various changes in form and details may be made without departing from the spirit and scope of the present invention.

What is claimed is:

1. Plug assembly of a rekeyable lock cylinder comprising:

a plug body having a plurality of pin holes;

a guide bar coupled to the plug body; and a plurality of pin assemblies respectively disposed within the pin holes of the plug body, each of the pin assemblies comprising a first rack component engaged with the guide bar, a second rack component selectively engaging with the first rack component and an elastic component disposed between the first rack component and the second rack component, wherein each of the elastic components has a first end contacting against the first rack component and a second end contacting against the second rack component.

2. The plug assembly in accordance with claim 1, wherein each of the pin holes has a center hole portion and a first cavity portion formed at one side of the center hole portion, the first cavity portion is in communication with the center hole portion.

3. The plug assembly in accordance with claim 2, wherein each of the first rack components has a rib portion having a top end and a front lateral, an extending portion formed extending from the top end of the rib portion and a first rack arrangement formed on the front lateral of the rib portion, the extending portion is located in the center hole portion of the pin hole.

4. The plug assembly in accordance with claim 3, wherein the first ends of the elastic components contact against the extending portions of the first rack components respectively.

5. The plug assembly in accordance with claim 4, wherein each of the extending portions has a notch, the first end of the elastic component is disposed within the notch of the extending portion.

6. The plug assembly in accordance with claim 3, wherein each of the pin holes has a second cavity portion formed at another side of the center hole portion, the second cavity portion is in communication with the center hole portion.

7. The plug assembly in accordance with claim 6, wherein each of the second rack components has a main body corresponding to the extending portion of the first rack component, a guiding portion formed at one side of the main body and a second rack arrangement formed at another side of the main body, the main body and the second rack arrangement are located in the center hole portion of the pin hole, and the guiding portion is located in the second cavity portion of the pin hole.

8. The plug assembly in accordance with claim 7, wherein the second ends of the elastic components contact against the main bodies of the second rack components respectively.

9. The plug assembly in accordance with claim 8, wherein each of the main bodies has an accommodating cavity, the second end of the elastic component is disposed within the accommodating cavity of the main body.

10. The plug assembly in accordance with claim 9, wherein each of the main bodies further has a pair of flanks formed protruding from a periphery of the accommodating cavity, the flanks are capable of orientating the elastic component.

11. The plug assembly in accordance with claim 10, wherein the flanks are corresponding to each other.

12. The plug assembly in accordance with claim 1, wherein the guide bar has a plurality of pin runners, the first rack components are engaged with the pin runners respectively.

13. The plug assembly in accordance with claim 12, wherein each of the first rack components has a rib portion, the rib portion is engaged with the pin runner.

14. The plug assembly in accordance with claim 13, wherein each of the rib portions has a front lateral, a back lateral and a catching protrusion protruding from the back lateral, the catching protrusion is engaged with the pin runner.

15. The plug assembly in accordance with claim 3, wherein the plug body has an outer surface, each of the extending portions has an arc surface capable of selectively flushing with the outer surface of the plug body.

* * * * *